US005613458A

United States Patent [19]

Owen

[11] Patent Number: 5,613,458

[45] Date of Patent: Mar. 25, 1997

[54] SHORE ANCHOR FOR SMALL BOATS & PERSONAL WATERCRAFT

[76] Inventor: Kelly Owen, 21067 Commerce Pointe Dr., Walnut, Calif. 91789

[21] Appl. No.: 448,496

[22] PCT Filed: Jul. 22, 1994

[86] PCT No.: PCT/US94/08291

§ 371 Date: May 19, 1995

§ 102(e) Date: May 19, 1995

[87] PCT Pub. No.: WO96/03308

PCT Pub. Date: Feb. 8, 1996

[51] Int. Cl.[6] ..... B63B 21/24

[52] U.S. Cl. ..... 114/230; 173/90; 52/155; 114/294

[58] Field of Search ..... 114/293–295, 230; 52/155–166; 119/786; 405/232; 135/118; 173/90, 91, 128, 129

[56] References Cited

U.S. PATENT DOCUMENTS

| | | | |
|---|---|---|---|
| 3,143,817 | 8/1964 | Paulson | 173/90 |
| 4,960,064 | 10/1990 | Mestas et al. | 114/230 |
| 4,971,479 | 11/1990 | Byers, Sr. et al. | 405/232 |

*Primary Examiner*—Edwin L. Swinehart

*Attorney, Agent, or Firm*—Christie, Parker & Hale, LLP

[57] ABSTRACT

A shore anchor for small boats and personal watercraft includes an elongated central spike-like member, two anvil collars, a slidable hammer weight, and a protective sheath. The anvils are used in conjunction with the slidable hammer weight to drive and retract the elongated spike into or out of the ground. The protective sheath covers the exposed end of the anchor when the anchor is deployed and is attached to the hammer weight. When the anchor is removed for transportation or storage the protective sheath covers the pointed end of the elongated spike and is attached to the other end of the hammer weight.

6 Claims, 2 Drawing Sheets

SHORE ANCHOR FOR SMALL BOATS & PERSONAL WATERCRAFT

This application is a 371 of PCT/US94/08291, Jul. 22, 1994.

1. Field of the Invention

The present invention pertains to a stake having a slidable captive hammer weight useful for driving the stake into the ground and for removing a driven stake from the ground. More particularly, it pertains to such a stake having a protective cover useful in both the driven and undriven states of stake.

2. Background of the Invention

A shore anchor is used to secure a small boat or personal watercraft, for example, to the shore when permanent docking structures are unavailable. Typically, a mooring line is tied from the boat or personal watercraft to a point on the shore provided by a shore anchor. The mooring often works in conjunction with an offshore anchor to prevent the boat or personal watercraft from drifting away from a desired, moored location between the shore and the offshore anchor.

With the rise in use of personal watercraft and smaller boats, a need has arisen for a shore anchor that can be safely transported on or in the watercraft or boat when not deployed. As personal watercraft are often used near and around heavily populated areas, a shore anchor must also be safe from harm to people when deployed to provide a mooring point.

Spike-like shore anchors are well known in the art. U.S. Pat. No. 4,960,064 to Mestas et al shows a land anchor comprised of a spike, a slidable hammer attached to the spike, and two stops located on the spike for limiting travel of the hammer along the spike. The hammer and stops are used to drive the spike into the ground and to remove the spike from the ground. Although the spike-like shore anchors known in the art provide the boat or water craft operator with a fixed point to secure the necessary mooring line, they have exposed sharp ends that can be dangerous or hazardous when they are transported. More significantly, the non-pointed end of a spike-like shore anchor also presents a danger and hazard to individuals on the shore who may trip over or fall onto the exposed end of the spike when the anchor is deployed and in use as a mooring point.

SUMMARY OF THE INVENTION

The present invention provides a captive-hammer spike-like shore anchor having a protective sheath or cover that allows for safe storage, movement, and deployment of the anchor. The sheath fits protectively over the exposed end of the anchor when the anchor is deployed. The sheath can be brightly colored to be highly visible to passers-by on the beach. The sheath can be used to cover the pointed end of the spike when the anchor is transported or stored.

Generally speaking, an anchor according to the present invention includes an anchor member, an annular hammer weight, and a generally tubular protective sheath. The anchor member is of elongated rod-like nature, and has a pointed end. A drive anvil is affixed to the anchor member substantially centrally of the length of the member, and a retraction anvil is affixed to the member proximate the other end of the anchor member. An annular hammer weight is slidably captive to and about the anchor member between the anvils. The hammer weight preferably is grooved so that it can be easily gripped by the operator. The sheath has a closed end and an open end via which the sheath is releasably connectable to either of the opposite ends of the hammer weight.

When the anchor is deployed, the protective sheath fits over the exposed end of the anchor member and is attachable to the slidable weight preferably via cooperating threads on the sheath and the weight. The protective sheath can be brightly colored so that is highly visible to individuals in the vicinity of the driven anchor. Bright coloring maximizes awareness of the anchor thus avoiding inadvertent contact by individuals on the shore. The protective sheath also minimizes possible harmful effects in the event a person falls on or against the upper end of the deployed anchor.

When the anchor is removed from the ground and not in use, the protective sheath can be placed over the pointed end of the spike-like anchor member and attached to the slidable weight. The anchor can then be transported safely. The protective sheath prevents contact between the pointed end of the spike and the water craft or occupants. The protective sheath also prevents the slidable weight from moving meaningfully along the anchor member during transportation and storage of the shore anchor.

As the protective sheath is brightly colored and highly visible while the anchor is deployed, it is envisioned that the protective sheath can contain advertising information or a company logo. In this way, the shore anchor can serve as an advertising beacon while it is deployed on the shore.

BRIEF DESCRIPTION OF THE DRAWINGS

The above-mentioned and other features and advantages of this invention will be appreciated as the same become better understood by reference to the following description of a presently preferred form of the anchor, which description is presented with reference to the accompanying drawings wherein.

DETAILED DESCRIPTION

Figure 1:
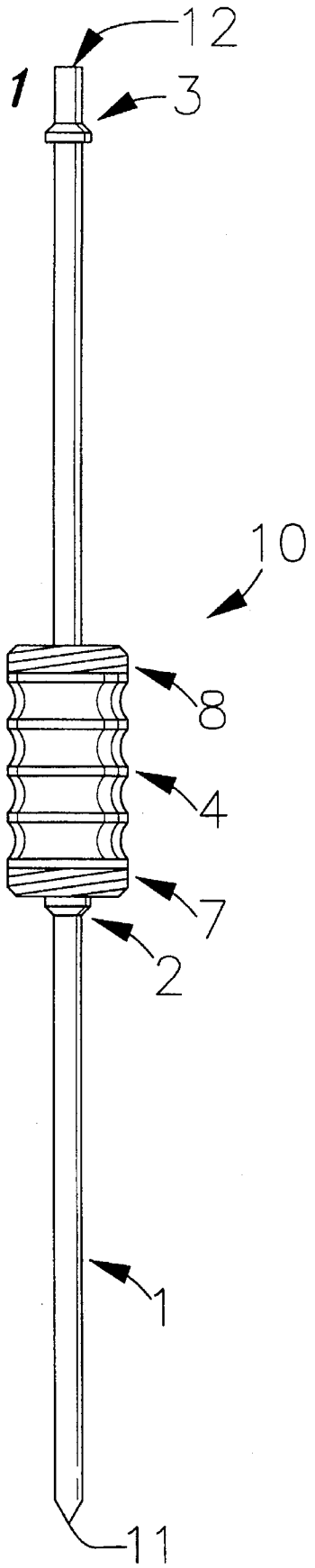
FIG. 1 is an elevation view of the shore anchor with the protective sheath removed.
Figure 2:
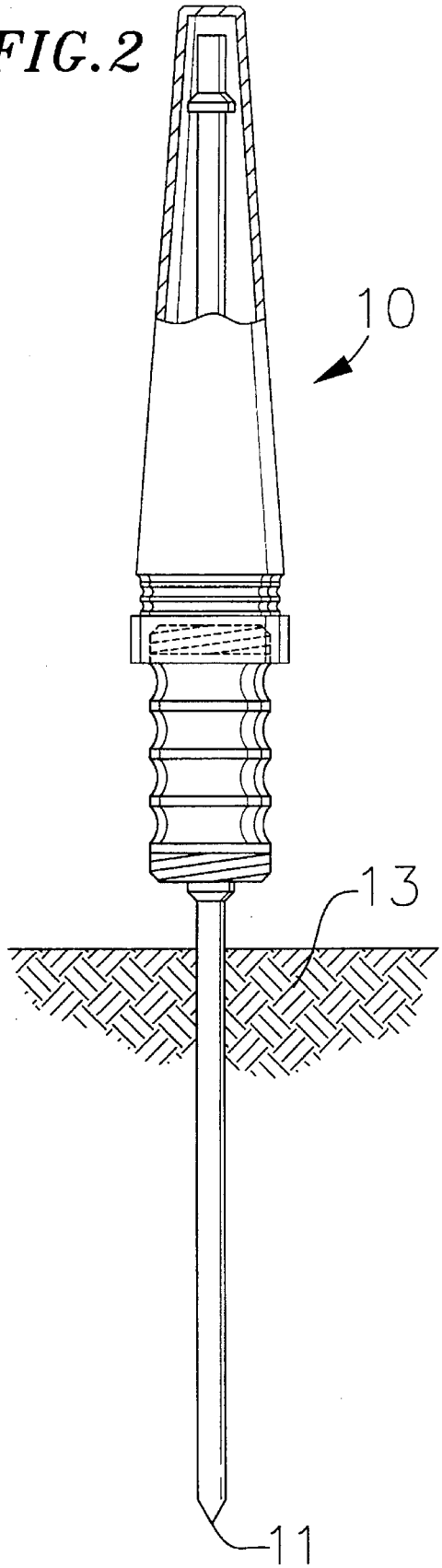
FIG. 2 is an elevation view of the shore anchor in an installed state with the protective sheath attached.
Figure 3:
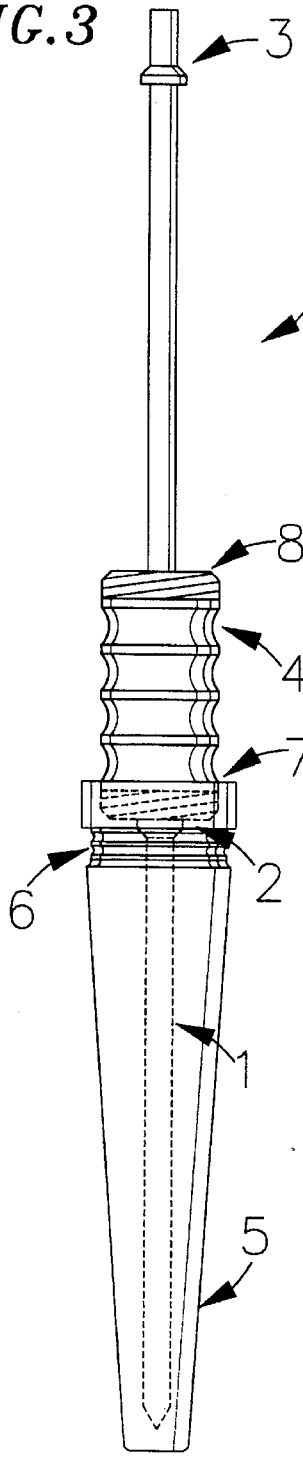
FIG. 3 is a view of a shore anchor with the protective sheath attached over the pointed end of the anchor to facilitate storage or transportation of the shore anchor.

A shore anchor according to this invention may be produced in a variety of sizes and by use of a variety of different materials to support the specific needs of particular users of the anchor. FIGS. 1, 2, and 3 and the following description pertain to a presently preferred shore anchor 10 that is suitable for use with small boats or personal watercraft. The presently preferred anchor consists of an elongate central spike-like anchor member 1, two anvil collars 2 and 3, a slidable annular hammer weight 4 and a protective sheath 5. One end 11 of the anchor member is pointed, and the other opposite end 12 preferably is not.

The anchor member 1, as shown in FIG. 1, preferably is comprised of a length of stainless steel rod, but aluminum or carbon steel rods can be used if desired. Affixed to member 1 are two anvil collars 2 and 3 as shown in FIG. 1. The collars preferably are heavy duty washers welded onto the spike, or they may be suitably formed through a method such as cold heading to be integrated with the spike.

The drive anvil 2 preferably is positioned so that it is immediately adjacent to the hammer weight 4, at the end of the weight which faces the pointed end 11 of the anchor member, when the midlength of the hammer weight 4 is a coincident with the midlength of anchor member 1. Such a position of the drive anvil minimizes the length of sheath 5.

Between the anvil collars 2 and 3 and attached to the anchor member 1 is a slidable annular hammer weight 4. As shown, it is preferred that the weight has circumferential grooves 12 formed in its surface intermediate its opposite end. The grooves allow the operator of the anchor to grip the weight and thrust it against either of the anvil collars. A protective sheath 5, as shown in FIGS. 2 and 3, fits over and is connectable to either end of the anchor member 1. The sheath preferably is formed out of hard plastic or rubber to allow for protection, at different times of, the opposite ends of the anchor member while not substantially adding to the weight of the anchor. The sheath has an open end 13 and an opposite closed end 14 between which the sheath preferably is tapered so that the closed end is of smaller area than the open end. The outer surfaces of the sheath adjacent its closed end preferably are defined so that the lower end of the sheath resembles a hex nut. Such a configuration enables the use of a wrench on the sheath if the connection between the sheath and weight 4 ever should become unduly tight as a consequence, for example if dirt or other foreign matter in that connection.

The shore anchor is deployed, i.e., driven into the ground 13 at a desired place, by suitably striking the grooved hammer weight 4 against the drive anvil 2. This process drives the pointed end 11 of the anchor member 1 into the ground and provides a stable point to which to tie a mooring line. The grooved hammer weight 4 rests against the drive anvil 2 upon deployment of the shore anchor. When the anchor is deployed, the protective sheath 5 is placed over the non-pointed end 12 of the anchor member 1 and affixed to the upper end of hammer weight 4.

The protective sheath 5 is attachable to the slidable hammer weight 4 preferably via internal threads (not shown) on the inside of sheath 5 at its open end 13 and via the external threads 7 and 8 at the lower and upper ends of the slidable weight 4. FIG. 2 depicts the shore anchor 10 as deployed with the protective sheath 5 covering the non-pointed end 11 of the anchor member 1 and attached to the grooved hammer weight 4 via threads 8. In that connection of the sheath to the weight, the closed end of the sheath is spaced closely above the upper end 12 of the anchor member.

The bright coloring of the protective sheath 5 provides for high visibility to passers-by on the shore. The surface of the protective sheath can also contain advertising or company logo information which will be visible to passers-by. The protective sheath 5 also reduces the danger associated with an exposed end 12 of the anchor member 1. The protective sheath 5 acts as a shield around the potentially dangerous exposed spike.

To remove the shore anchor from deployment and prepare it for transportation and/or storage, the protective sheath 5 is removed from the non-pointed end 12 of the anchor member 1 by disconnecting the sheath from the upper end of the weight. The slidable grooved hammer weight 4 is then used to retract the shore anchor 10 by suitably striking it against the retraction anvil 3. The grooves on the hammer weight allow it to be easily gripped by the operator. When the striking of the grooved hammer weight 4 against the retraction anvil 3 sufficiently forces the pointed end 11 of the anchor member 1 out of the ground, the protective sheath 5 can then be placed over the pointed end 11 of the anchor member 1 and connected to the lower end of the weight. In that connection of the sheath to the weight, the closed end of the sheath is spaced closely to the pointed end of the anchor member and the weight is held at or very close to drive anvil 2. In that condition, the weight cannot slid freely along the anchor member.

The protective sheath 5 is attached to the shore anchor 10 over the pointed end 11 of the anchor member 1 preferably via internal threads on the protective sheath and external threads 7 on the slidable weight. In order for the protective sheath so to connect with the hammer weight, the weight 4 must rest substantially on the drive anvil 2.

Once the protective sheath 5 is attached to the hammer weight, the weight becomes substantially immobilized on the shore anchor against the drive anvil 2. Weight 4 cannot slide between the two anvil collars 2 and 3. The protective sheath 5 also eliminates contact with the pointed end 11 of the anchor member 1, thereby reducing the danger associated with transporting the pointed spike. The sheath facilitates safe transportation and storage of the shore anchor 10 is depicted in FIG. 3.

Figure 4:
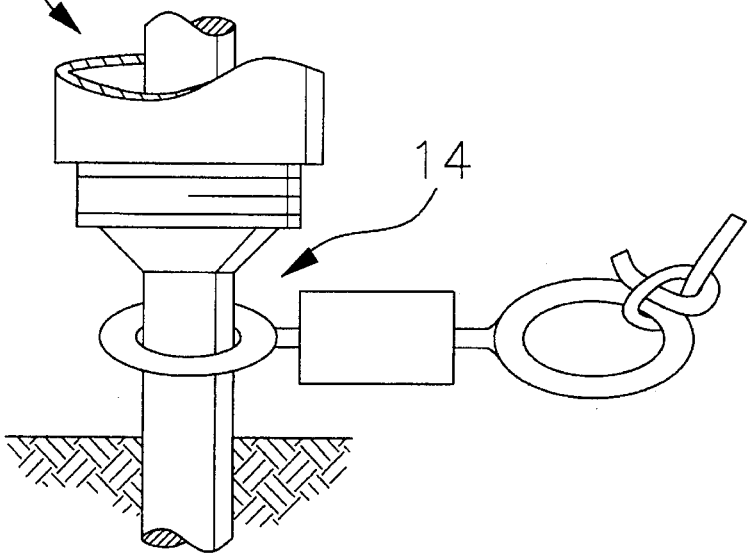
FIG. 4 is a fragmentary elevation view showing use of the anchor as an exercise tether point for a movable body such as a dog.

FIG. 4 illustrates another use for anchor 10. One loop of a suitably sized double-loop swivel 20 is engaged around the anchor member 1 of the driven anchor 10 below the-drive anvil and the ground. To the other loop of the swivel can be tied a dog leach 21, e.g. it is thus seen that anchor 10 can be used as an animal exercise point about which the animal can freely move within a radius defined by the length of a leash or other tether used to connect the animal to the anchor.

The foregoing description is presented with reference to a presently referred anchor assembly according to this invention for purposes of illustration. The invention can be embodied in other structural arrangements. For example, connection features other than threads can be provided on the weight and the sheath to provide releasable connection of the sheath to either end of the weight.

What is claimed is:

1. An anchor device anchor comprising an elongated rod-like anchor member one end of which is pointed, a drive anvil affixed to the anchor member, a retraction anvil affixed to the anchor member in spaced relation to the drive anvil, an annular weight engaged around the anchor member and slidable therealong between the anvils, and an elongated sheath having a closed end and an open end at which the sheath defines connection features which are releasably cooperable with cooperating connection features at opposite ends of the weight.

2. Apparatus according to claim 1 in which the sheath has a length defined in cooperation with the length of the anchor member and with the position of the drive anvil on the member to enclose the other end of the member when the weight substantially rests on the drive anvil and the sheath is connected to the weight.

3. Apparatus according to claim 1 in which the sheath has a length defined in cooperation with the length of the anchor member and with the position of the drive anvil on the member to enclose the pointed end of the anchor member when the weight is substantially engaged with the drive anvil and the sheath is connected to the weight.

4. Apparatus according to claim 1 in which the position of the drive anvil on the anchor member corresponds to an end of the weight when the midlelengths of the weight and the anchor member are coincident.

5. Apparatus according to claim 1 in which the defined connection features consist of external threads on opposite ends of the weight and cooperating with internal threads on the sheath.

6. Apparatus according to claim 1 wherein the sheath is brightly colored and highly visible when deployed.

* * * * *